US005083555A

United States Patent [19]

Lewis

[11] Patent Number: 5,083,555

[45] Date of Patent: Jan. 28, 1992

[54] APPARATUS TO REDUCE WRINKLES IN HUMAN BREASTS

[76] Inventor: Ernestine Lewis, 877 Sungold Cir., Livermore, Calif. 94550

[21] Appl. No.: 624,791

[22] Filed: Dec. 4, 1990

Related U.S. Application Data

[63] Continuation of Ser. No. 228,456, Aug. 5, 1988, abandoned.

[51] Int. Cl.[5] ..... A61F 5/02; A61F 5/08

[52] U.S. Cl. ..... 128/78; 128/76 B; 5/436; 5/490; 450/69

[58] Field of Search ..... 5/431, 434, 436, 489, 5/490, 491; 2/44; 128/76 B, 78, 155, 845; 450/2, 40, 65, 69, 96; 623/7

[56] References Cited

U.S. PATENT DOCUMENTS

| | | | |
|---|---|---|---|
| 875,329 | 12/1907 | David | 5/491 |
| 3,378,860 | 4/1968 | Frazier | 5/491 |
| 3,417,413 | 12/1968 | Gage | 5/436 |
| 4,081,870 | 4/1978 | Iannucci | 5/491 |
| 4,257,412 | 3/1981 | Guttentog | 128/113.1 |
| 4,356,579 | 11/1982 | Bond | 128/57 |
| 4,773,106 | 9/1988 | Toso et al. | 128/78 X |

FOREIGN PATENT DOCUMENTS

| | | | |
|---|---|---|---|
| 1366993 | 6/1964 | France | 128/155 |

*Primary Examiner*—Ronald Frinks
*Assistant Examiner*—Paul Prebilic
*Attorney, Agent, or Firm*—Patula and Associates

[57] ABSTRACT

An apparatus, suitable for reducing and preventing skin deformation in proximity to the breasts of a human female when worn between said breasts, includes a shaped deformable resilient central support member having a first end and a second end. A removable outer casing encompasses the shaped central support member, the casing having a first casing end adjacent the first support member end and a second casing end adjacent the second support member end. A first closure means is positioned at the first casing end and a second closure means is positioned at the second casing end, the closure means being adapted for enclosing the first and second support member ends within the outer casing. A securing means is on the outer casing between the first and second casing ends, the securing means being adapted for securing the apparatus to the torso of a human female and between the breasts of the female to reduce and eliminate skin wrinkling.

35 Claims, 1 Drawing Sheet

APPARATUS TO REDUCE WRINKLES IN HUMAN BREASTS

This is a continuation of application Ser. No. 228,456, filed Aug. 5, 1988 now abandoned.

This invention relates generally to an apparatus designed to reduce wrinkles in human breasts, and specifically to a cylindrical bolster or pillow used to prevent wrinkles or to soften existing wrinkles in the upper bustline of women who sleep on their sides. The invention is fabricated from a piece of semi-firm deformable resilent material which, for comfort, may be covered with an outer casing made of washable satin and held in place by elastic sewn at both ends for easy removal. The invention is placed between the breasts and secured by either the wearer's sleeping garment or by a belt.

BACKGROUND OF THE INVENTION

As women age, lose weight, or become inactive, their bustlines tend to be less firm. When women sleep on their sides, their breasts hang together causing wrinkles to form in the center of the chest, just above and between their breasts.

Although the past few years have witnessed the development of therapeutic bolsters and corrective brassieres, there is no prior art known which functions to reduce or to prevent wrinkles in human breasts.

The prior art discloses several bolsters used for conventional and therapeutic purposes. A conventional bolster is disclosed in U.S. Pat. No. 3,378,860 to Frazier, wherein the bolster comprises a rigid, hollow frame with a foam material covering the frame. The invention does not suggest its use between the breasts in order to reduce wrinkles in the upper bustline.

Other therapeutic bolsters are depicted in U.S. Pat. Nos. 4,356,579 to Bond and 4,081,870 to Iannucci. Bond discloses bolster-type cushions with good handling and manipulative characteristics for therapeutic use, such as for patients reclining in a sleeping bed or convalescents utilizing chair-like supports. The bolster-type cushion is provided with a handle for easy maneuvering, a waterproof jacket to allow liberal immersion or cleansing, and treads and other means for stabilizing the cushion. The inventions disclosed in these prior devices do not suggest their use between breasts to reduce wrinkles in the upper bustline of women.

Iannucci discloses a bolster used for physical therapy, especially for handicapped children. The bolster comprises a set of spaced, hollowed-out disks, with a solid disk at each end, a cylindrical shell made of rigid material such as sheet metal which is wrapped about the disks, and foam rubber first adhered to the shell and then covered with vinyl. The invention disclosed does not suggest its use between breasts to reduce wrinkles in the wearer.

U.S. Pat. No. 4,257,412 to Guttentag depicts a mastectomy brace, which exerts pressure on a breast implant to correct the projection of the reconstructed breast into compliance with that of a normal breast. Unlike the present invention, which is placed between the breasts, the mastectomy brace engages the upper and outer surfaces of the breast as well as the chest area surrounding the breast sides and is for directing the breasts' projection.

None of the prior art patents discussed above addresses the need to reduce or prevent wrinkles in the upper bustline. Accordingly, the present invention, as disclosed and claimed herein, is believed to provide a novel apparatus designed to lessen wrinkles which form in the upper bustline of human breasts while the wearer sleeps on her side.

BRIEF SUMMARY OF THE INVENTION

A primary object of the present invention is to provide a simple and inexpensive method of reducing wrinkles in the upper bustline of human breasts.

The invention relates to an apparatus designed to reduce or prevent wrinkles in the area above and between the breasts of women who sleep on their sides, and to an inexpensive method of producing the same. The apparatus is comprised of a cylindrical semi-firm deformable resilent material such as foam rubber, and may have an outer casing made of washable satin with elastic sewn at both ends for easy removal and washing purposes. The casing may have lace sewn on the elastic for decorative and aesthetic purposes. The invention is placed between the breasts, with the top end located just beneath the collarbone, and is secured by either sleeping garments or if the woman sleeps nude, by a belt or other means which ties the invention in place. The invention is secured in a manner which keeps the breasts separated, thereby preventing wrinkles from forming and softening existing wrinkles.

The present invention is simple and easy to manufacture and may therefore be manufactured and sold at an inexpensive cost. Another advantage of the invention is that, although the apparatus is therapeutic and preventive, it is available to women without a prescription and therefore spares women the embarrassment and high cost of consulting with a doctor or a cosmetologist.

The primary object of the present invention is to provide a therapeutic apparatus to reduce and soften wrinkles above and between human breasts which may form due to old age, weight loss, inactivity, or pregnancy.

Another object of the invention is to provide a comfortable and ergonomic method of preventing wrinkles from forming in the breasts of women who sleep on their sides.

Yet another object of the present invention is to provide a simple and easy to use apparatus for reducing existing wrinkles in the area above and between human breasts.

Still another object of the invention is to provide women with a painless and low cost alternative to cosmetic surgery for improving the physical appearance of their breasts.

Numerous other objects, advantages and features of the invention will become readily apparent from the following detailed description of the invention, from the drawings in which like reference numerals are employed to designate like parts, and from the claims presented herein.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
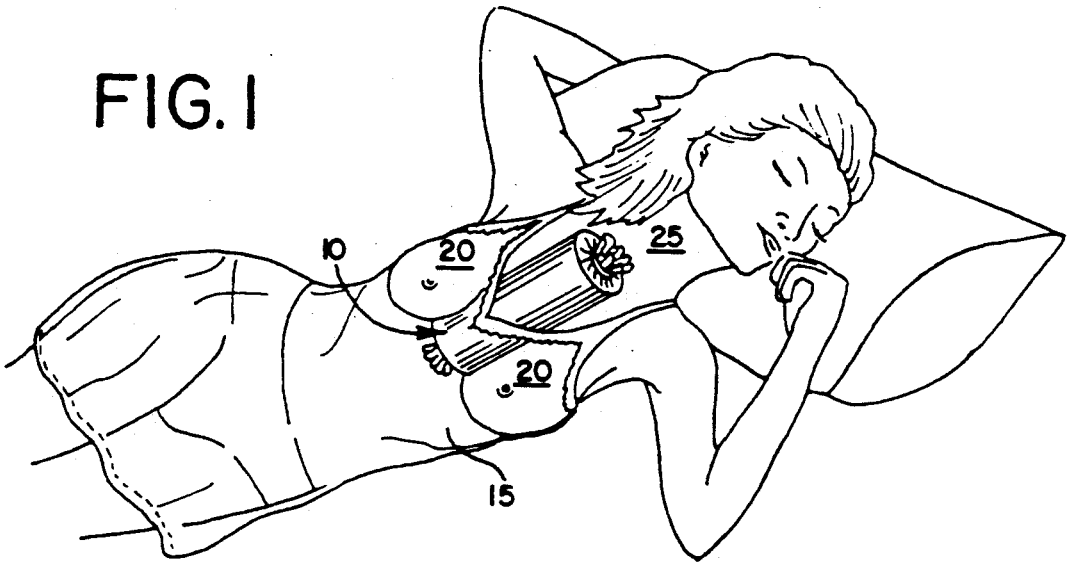
FIG. 1 is a perspective view of the apparatus of the present invention to reduce wrinkles in human breasts wherein the device is shown positioned between the wearer's breasts while she is reclining on her side.

While the invention is suspectible of embodiment in many different forms, there is shown in the drawings and will herein be described in detail, a preferred embodiment of the invention. It should be understood, however, that the present disclosure is to be considered as an exemplification of the principles of the invention, and that it is not intended to limit the spirit and scope of the invention and/or claims to the embodiments illustrated.

Referring now to FIG. 1, which is a perspective view of the apparatus to reduce wrinkles in the human breasts, the device is referred to generally by reference character 10. It is positioned between a women's breasts 20 and is located just below the wearer's collarbone and extended between the wearer's breasts 20 as the wearer 25 is reclining on her side while resting or sleeping.

Figure 2:
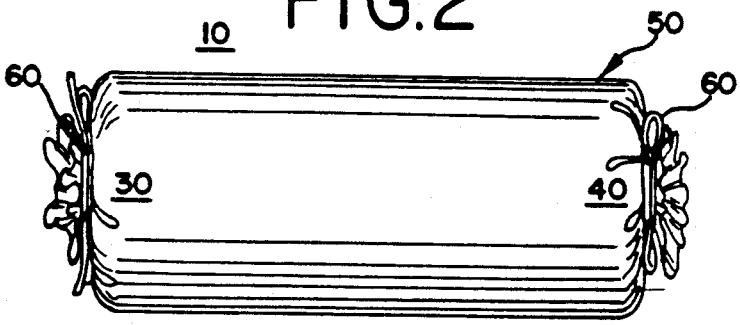
FIG. 2 is a side view of the inventive apparatus to reduce wrinkles in human breasts.

FIG. 2 is a side view of the apparatus 10 of the present invention fashioned in the form of a cylinder having two ends 30 and 40 and covered with a soft covering 50 of satin or other fabric which is comfortable to the wearer's skin. The invention 10 may be elongated, contoured or of some other shape instead of cylindrical. The invention may be made from any number of resilient materials such as foam rubber.

Figure 3:
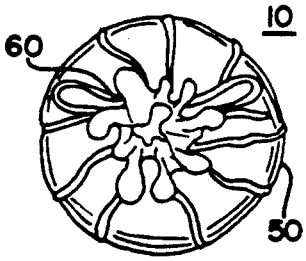
FIG. 3 is an axial end view of the device of FIG. 2.

FIG. 3 is an axial end view of the apparatus of the present invention showing an elastic fastening means or other fastening means 60 which gathers the fabric covering 50 at each of the ends 30 and 40 (as shown in FIG. 2) in order to fasten the covering fabric 50 to the cylinder.

Figure 4:
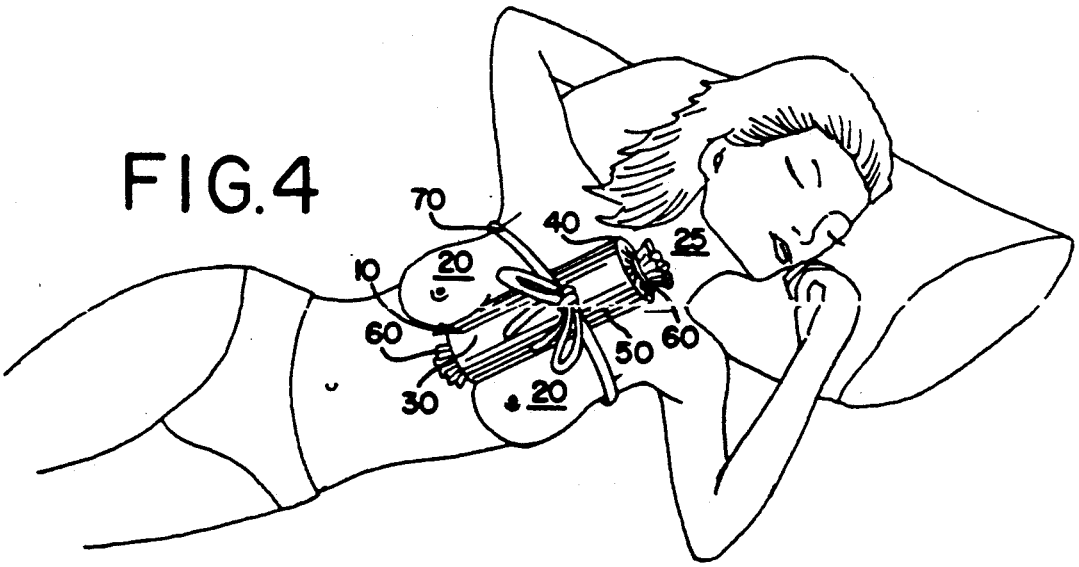
FIG. 4 is a perspective view of the present invention wherein the device is positioned between the wearer's breasts and held in place by an alternative securing means while the wearer is reclining on her side.

FIG. 4 is an alternative perspective view of the apparatus 10 having the two ends 30 and 40 and covered with the fabric covering 50 which is held in place by a fastening means 60 at each end 30 and 40. The apparatus 10 is positioned between the wearer's breasts 20 and the held in place by strap 70, which may be of satin or cotton fabric or any other material, and which holds the apparatus 10 in place when the wearer 25 reclines or sleeps nude or without a nightgown. The alternative securing means 70 is shown positioned below the wear's arms and above the wearer's breasts 20 in order to secure the apparatus 10 in place.

Use of the present invention is simply and effectively described as follows. If the wearer 25 wishes to reduce or prevent wrinkles in her bustline above and between the breasts 20, the wearer 25 will position the apparatus 10 between her breasts 20 under her garment 15. The garment 15 is of conventional design and acts to secure the apparatus in place. The apparatus 10 will stay in position between wearer's breasts 20 as the wearer 25 sleeps on her side, thereby reducing the pull and stretch of the breasts 20 caused by one hanging over the other as the wearer sleeps.

Alternatively, as shown in FIG. 4, the woman can position the apparatus 10, and by means of strap 70, can hold the apparatus 10 in place between her breasts 20 and below her armpits 25 to thereby secure the apparatus 10 when the wearer 25 sleeps nude or without some type of upper body clothing. When the apparatus 10 becomes soiled, the fabric covering 50 may be removed from the covered cylinder for cleaning by releasing the ties 60, which may be of elastic or other means, at each end 30 and 40 in order to then remove covering 50 from the apparatus for cleaning and/or replacement.

It is contemplated that the apparatus 10 may be configured of a resilient deformable material, such as foam rubber or other similar material, in order to provide sufficient support for the wearer's breasts 20 while she sleeps on her side. It is also intended that the apparatus of the present invention may be configured or contured in shapes other than a cylinder.

While the foregoing disclosure has presented certain specific embodiments of the present invention, it is to be understood that these embodiments have been presented by way of example only. It is expected that others will perceive differences in the size, shape and material of the present invention which, while bearing from the foregoing, do not depart from the spirit and scope of the invention herein described and claimed.

What is claimed is:

1. A therapeutic apparatus, suitable for reducing and preventing skin deformation in proximity to the breasts of a human female, which comprises in combination:
   a) a shaped deformable resilient central support member having a first end and a second end;
   b) an outer casing encompassing said shaped central support member, said casing having a first casing end adjacent said first support member end and a second casing end adjacent said second support member end;
   c) first tied closure means at said first casing end and second tied closure means at said second casing end, said closure means being adapted for enclosing said first and second support member ends within said outer casing to thereby fully enclose said shaped central support member; and,
   d) securing means on said outer casing between said first and second casing ends, said securing means being adapted for securing said apparatus to the torso of a human female and between the breasts of said female.

2. The apparatus according to claim 1 wherein said central support member is shaped in cylindrical form.

3. The apparatus according to claim 1 wherein said central support member is semi-rigid.

4. The apparatus according to claim 1 wherein said central support member is formed of a foam material.

5. The apparatus according to claim 4 wherein said foam material is foam rubber.

6. The apparatus according to claim 1 wherein said outer casing is removable from said shaped central support member.

7. The apparatus according to claim 1 wherein said outer casing is formed of a fabric.

8. The apparatus according to claim 7 wherein said fabric is washable.

9. The apparatus according to claim 7 wherein said fabric comprises satin.

10. The apparatus according to claim 1 wherein said closure means comprises an elastic material.

11. The apparatus according to claim 1 wherein said securing means comprises a strap.

12. A therapeutic apparatus, suitable for reducing and preventing skin deformation in proximity to the breasts of a human female, which comprises in combination:
   a) a shaped deformable resilient central support member having a first end and a second end;
   b) a removable outer casing encompassing said shaped central support member, said casing having at least a first casing end adjacent said first support member end;

c) first tied closure means at said first casing end, said first tied closure means being adapted for enclosing said first support member end within said outer casing to thereby fully enclose said shaped central support member; and, d) securing means on said outer casing and spaced from said first casing end, said securing means being adapted for securing said apparatus to the torso of a human female and between the breasts of said female.

13. The apparatus according to claim 12 wherein said central support member is shaped in cylindrical form.

14. The apparatus according to claim 12 wherein said central support member is semi-rigid.

15. The apparatus according to claim 12 wherein said central support member is formed of a foam material.

16. The apparatus according to claim 15 wherein said foam material is foam rubber.

17. The apparatus according to claim 12 wherein said outer casing is formed of a fabric.

18. The apparatus according to claim 17 wherein said fabric is washable.

19. The apparatus according to claim 17 wherein said fabric comprises satin.

20. The apparatus according to claim 12 wherein said closure means comprises an elastic material.

21. The apparatus according to claim 12 wherein said securing means comprises a strap.

22. A therapeutic apparatus, suitable for reducing and preventing skin deformation in proximity to the breasts of a human female, which comprises in combination:

a) a shaped deformable resilient central support member having a first end and a second end;

b) an outer casing encompassing said shaped central support member, said casing having a first casing end adjacent said first support member end and a second casing end adjacent said second support member end;

c) first drawstring closure means at said first casing end and second drawstring closure means at said second casing end, said closure means being adapted for enclosing said first and second support member ends within said outer casing to thereby fully enclose said shaped central support member; and d) said central support member positioned between the breasts of a human female.

23. The apparatus according to claim 22 wherein said central support member is shaped in cylindrical form.

24. The apparatus according to claim 22 wherein said central support member is semi-rigid.

25. The apparatus according to claim 22 wherein said central support member is formed of a foam material.

26. The apparatus according to claim 25 wherein said foam material is foam rubber.

27. The apparatus according to claim 22 wherein said outer casing is removable from said shaped central support member.

28. The apparatus according to claim 22 wherein said outer casing is formed of a fabric.

29. The apparatus according to claim 28 wherein said fabric is washable.

30. The apparatus according to claim 28 wherein said fabric comprises satin.

31. The apparatus according to claim 22 wherein said closure means comprises an elastic material.

32. The apparatus according to claim 22 wherein said closure means comprises a tie.

33. A method of reducing and preventing skin deformation in proximity to the breasts of a human female, comprising the step of:

positioning shaped deformable resilient central support member between the breasts of the human female for a period of time, said support member having a first end and a second end; an outer casing encompassing said shaped central support member, said casing having a first casing end adjacent said first support member end and a second casing end adjacent said second support member end; first tied closure means at said first casing end and second tied closure means at said second casing end, said tied closure means being adapted for enclosing said first and second support member ends within said outer casing to thereby fully enclose said shaped central support member; securing means on said outer casing between said first and second casing ends, said securing means being adapted for securing said apparatus to the torso of a human female and between the breasts of said female.

34. A method for reducing and preventing skin deformation in proximity to the breasts of a human female, which comprises the step of:

positioning a shaped deformable resilient central support member between the breasts of a human female for a period of time and said support member having a first end and a second end; a removable outer casing encompassing said shaped central support member, said casing having at least a first casing end adjacent said first support member end; first tied closure means at said first casing end, said first tied closure means being adapted for enclosing said first support member end within said outer casing to thereby fully enclose said shaped central support member; securing means on said outer casing and spaced from said first casing end, said securing means being adapted for securing said apparatus to the torso of a human female and between the breasts of said female.

35. A method of reducing and preventing skin deformation in proximity to the breasts of a human female, comprising the step of:

positioning a shaped deformable resilient central support member between the breasts of the human female for a period of time, said support member having a first end and a second end; an outer casing encompassing said shaped central support member, said casing having a first casing end adjacent said first support member end and a second casing end adjacent said second support member end; first drawstring closure means at said first casing end and second drawstring closure means at said second casing end, said closure means being adapted for enclosing said first and second support member ends within said outer casing to thereby fully enclose said shaped central support member; said central support member positioned between the breasts of a human female.

* * * * *